US006905196B2

(12) United States Patent
Seabridge et al.

(10) Patent No.: US 6,905,196 B2
(45) Date of Patent: Jun. 14, 2005

(54) POLYSILICON FEED-THROUGH FLUID DROP EJECTOR

(75) Inventors: Scott N. Seabridge, Penfield, NY (US); Alan D. Raisanen, Sodus, NY (US); Scott C. Warner, Ontario, NY (US); Thomas A. Tellier, Wolcott, NY (US); Cathie J. Burke, Rochester, NY (US); William G. Hawkins, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/431,540

(22) Filed: May 8, 2003

(65) Prior Publication Data

US 2003/0210301 A1 Nov. 13, 2003

Related U.S. Application Data

(60) Provisional application No. 60/378,398, filed on May 8, 2002.

(51) Int. Cl.[7] ..... B41J 2/05

(52) U.S. Cl. ..... 347/58

(58) Field of Search ..... 347/58, 59, 54, 347/56, 61, 62, 63, 68, 72, 84, 85; 216/4, 48

(56) References Cited

U.S. PATENT DOCUMENTS 6,227,657 B1 5/2001 Raisanen et al.
6,315,384 B1 11/2001 Ramaswami et al.
6,565,762 B1 * 5/2003 Silverbrook ..... 216/27

* cited by examiner

*Primary Examiner*—Raquel Yvette Gordon
(74) *Attorney, Agent, or Firm*—Oliff & Berridge, PLC

(57) ABSTRACT

A fluid ejector includes a fluid channel having a resistive heater and terminating in a nozzle, a common bus formed transverse to the fluid channel and between the resistive heater and the nozzle, a connection line laterally adjacent to the fluid channel, and a connection structure for electrically connecting the common bus with the resistive heater and the connection line, the connection structure including a first set of one or more layers for electrical connection and a second set of one or more layers for covering the common bus and connection line. The first set of one or more layers includes a doped polysilicon layer on or overlaid by an optional tantalum-silicide layer. The second set of one or more layers includes a nitride layer on or overlaid by a tantalum layer.

36 Claims, 9 Drawing Sheets

POLYSILICON FEED-THROUGH FLUID DROP EJECTOR

This nonprovisional application claims the benefit of U.S. Provisional Application No. 60/378,398, filed May 8, 2002.

BACKGROUND OF THE INVENTION

1. Field of Invention

This invention relates generally to the mechanical and electrical structure of fluid drop ejectors.

2. Description of Related Art

A conventional thermal inkjet transducer array is essentially a large bank of thin-film resistive heaters electrically connected in parallel. In particular, a thermal inkjet printer comprises an array of drop ejectors. Each drop ejector has an ink channel having an inlet end and a nozzle end and contains a resistive heater. The nozzle end of each resistive heater in the array of drop ejectors is connected to a common electrical bus, which in turn is connected to an electrical power supply providing a printer operating voltage. Each individual drop ejector is driven to eject a droplet of ink by grounding an inlet end of the resistive heater through an individually-addressable driver transistor.

Often, fluid ejection systems, such as inkjet printers, include an array of thin-film drop ejectors electrically connected in parallel. A drop ejector includes a channel into which fluid flows, a resistive heater to vaporize a portion of the fluid to form a bubble in the chamber, and a nozzle through which fluid downstream of the vapor bubble ejects from the chamber to form a drop projected towards a receiving medium. Vaporizing the fluid creates pressure in the channel forcing the fluid collected downstream of the heater out of the nozzle.

Each drop ejector in the array connects to a common electrical bus communicating with an electrical power supply. Each ejector is controlled by grounding an electrical supply end through an individually-addressable driver transistor. Design optimization encourages a narrow electrical bus for minimal nozzle length, and thick cross-section structures to minimize electrical resistance. Such a thick bus, underneath the channel (~6–7 $\mu$m high), can present an obstacle over which the fluid must flow. Such a flow restriction can induce lateral forces to the fluid being ejected, creating potential directional biases and/or variations in the drop and/or satellite trajectories, thereby degrading ejection quality.

The common electrical bus should be narrow, so that the length of the ink nozzle can be kept as short as possible. This tends to increase drop ejection energy efficiency. To reduce the electrical series resistance of the common bus, it is desirable to make the common bus relatively thick. Often, the common bus will have two or more layers of metal and/or polysilicon. However, this thick bus structure presents a "bump"-shaped obstacle in the nozzle that misdirects the ejected main drop and/or associated satellite droplets that are ejected with the main drop. The misdirected satellite drops tend to limit the print quality achievable with drop ejectors having this bump-shaped obstacle. Unfortunately, no reasonable alternative to these drop ejectors was previously available.

A fluid ejector having a low topography formed by rerouting the electrical conductors from underneath to adjacent to the chamber is disclosed in U.S. Pat. No. 6,227,657 (the 657 patent), which is incorporated herein by reference in its entirety. This low topography fluid drop ejector provides for an electrical contact structure to the resistive heater that avoids placing relatively thick electrical contact layers in a fluid drop ejection path between the resistive heater and the ejector nozzle.

SUMMARY OF THE INVENTION

However, manufacturing and operational considerations for fluid ejector designs have revealed limitations to the approach described in the 657 patent. The low topography fluid ejector disclosed in the 657 patent incorporates electrically conductive metal layers separated by a concatenation of insulating layers along selected regions. Unavoidable production flaws along the interface edges of these layers can reduce the operational longevity of the circuit and/or adversely affect production yield. Over-etching on one or more of these layers can exacerbate the variation in the electrical resistance far beyond the allowable design value tolerances.

While the layered electrical and structural configuration disclosed in the 657 patent diminishes the flow obstructions in the fluid ejection channel, the added complexity in depositing patterned layers makes it difficult to control quality and/or obtain commercially useful yields. Further, the connections between the metal layer and the heavily doped polysilicon layer penetrate the protective layer.

Because of the cross-layer interface, the edge junctions between these layers facilitate leak paths through which the fluid and/or fluid vapors can percolate, thus degrading performance and reliability. Additionally, such interfaces at these layer edges require additional patterned insulating layers, thickening the overall structure.

This invention provides a fluid channel having a low-topography using a relatively simple internal structure.

This invention separately provides a low-topography fluid channel that reduces the number of leak paths into the fluid channel.

This invention separately provides a low-topography fluid channel that can be manufactured at higher yield rates.

This invention separately provides a low-topography fluid channel having increased reliability.

This invention separately provides a low-topography fluid channel having a fluid channel having a relatively simple internal structure.

This invention separately provides a method for forming a tantalum-silicide layer in a fluid ejector.

By eliminating interface connections between metal and semiconductor layers, the cross-sectional structure may be further flattened relative to the low-topography fluid ejector device disclosed in the 657 patent. This can further improve droplet trajectory control. Additionally, enhanced reliability can result by reducing potential failure modes associated with over-etching along these interfaces.

In various exemplary embodiments, a thermal fluid ejector structure according to this invention includes a fluid channel having a resistive heater that terminates in a nozzle, and a common bus formed transverse to the fluid channel and extending between the resistive heater and the nozzle. The fluid ejector further includes a connection line that extends longitudinally adjacent to the fluid channel, and a connection structure that electrically connects the common bus with the resistive heater and the connection line. The connection structure includes a first set of one or more layers that electrically connects the connection line to the resistive heater and a second set of one or more layers that covers the common bus and the connection line.

In various exemplary embodiments, the first set of one or more layers can be formed on or over a field oxide layer, and can further include a heavily doped polysilicon layer formed on or over the field oxide layer and a tantalum-silicide layer formed on or over the heavily doped polysilicon layer. In various exemplary embodiments, a second set of one or more layers can be formed on or over the first set of one or more layers and can further include a nitride layer formed on or over the first set of one or more layers, and a tantalum layer formed on or over the nitride layer.

In various exemplary embodiments, a fluid channel can be formed on or over the field oxide layer and can further include a heavily doped polysilicon layer formed on or over the field oxide layer upstream of the nozzle, a tantalum-silicide layer formed on or over the heavily doped polysilicon layer, a lightly doped polysilicon layer formed on or over the field oxide layer adjacently upstream of and electrically connected with the heavily doped polysilicon layer, and a set of protective layers formed on or over the tantalum-silicide layer and the lightly doped polysilicon layer. The set of protective layers can further include a nitride layer formed on or over the tantalum-silicide layer and the lightly doped polysilicon layer, and a tantalum layer formed on or over the nitride layer.

In various exemplary embodiments, a common bus can be formed on or over the field oxide layer and can further include a first set of one or more layers formed on or over the field oxide layer, a lightly doped polysilicon layer formed on or over the field oxide layer adjacent to and electrically separated from the first set of one or more layers, an insulating layer formed on or over the first set of one or more layers and a first portion of the lightly doped polysilicon layer, and a second set of one or more layers formed on or over the insulating layer and a second portion of the lightly doped polysilicon layer. The first set of one or more layers can further include a heavily doped polysilicon layer formed on or over the field oxide layer and a tantalum-silicide layer formed on or over the first doped polysilicon layer. The second set of one or more layers can further include a nitride layer formed on or over the tantalum-silicide layer and the second doped polysilicon layer, and a tantalum layer formed on or over the nitride layer.

Various exemplary embodiments of a method to produce a low topography fluid ejector according to this invention include forming a fluid channel having a resistive heater and terminating in a nozzle, forming a common bus transverse to the fluid channel and between the resistive heater and the nozzle, forming a connection line longitudinally adjacent to the fluid channel, forming a first set of one or more layers that electrically connects the common bus with the resistive heater and the connection line, and forming a second set of one or more layers that covers the common bus and the connection line. Forming the first set of one or more layers over the field oxide layer further includes forming a first doped polysilicon layer on or over the field oxide layer, and optionally forming a tantalum-silicide layer on or over the first doped polysilicon layer. Forming the second set of one or more layers over the first set of the one or more layers further includes forming a nitride layer on or over the first set of the one or more layers, and forming a tantalum layer on or over the nitride layer.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention will be described in detail with reference to the following figures, wherein.

DETAILED DESCRIPTION OF EXEMPLARY EMBODIMENTS

The following detailed description of various exemplary embodiments of the fluid ejection systems according to this invention are directed to one specific type of fluid ejection system, an inkjet printer, for sake of clarity and familiarity.

However, it should be appreciated that the principles of this invention, as outlined and/or discussed below, can be equally applied to any known or later developed fluid ejection systems, beyond the inkjet printer specifically discussed herein.

Figure 1:
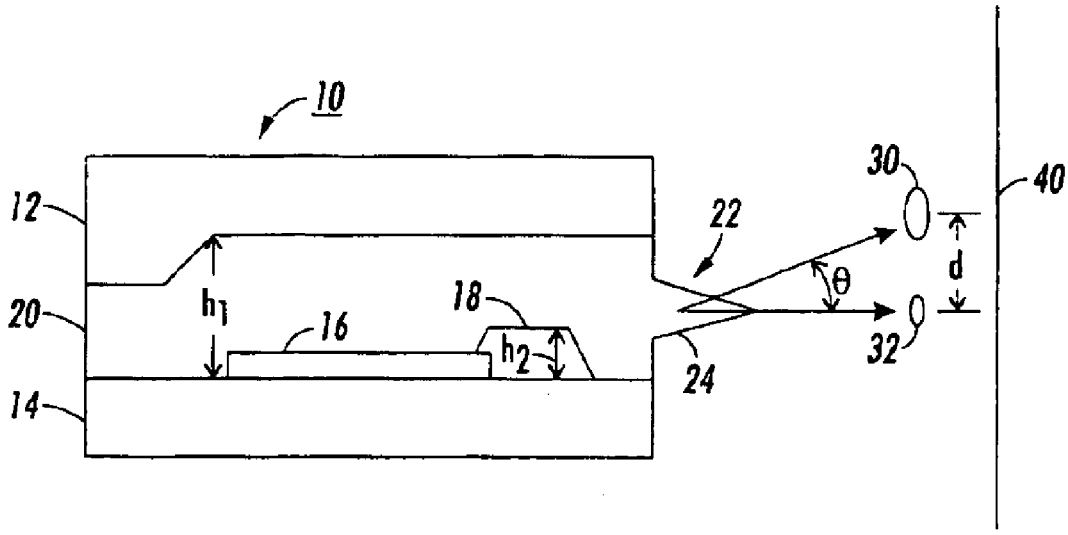
FIG. 1 (PRIOR ART)
FIG. 1 illustrates the effect of ink channel topography on ink drop formation.

FIG. 1 illustrates the effect on ink drop formation caused by the nozzle topography of a conventional inkjet printhead drop ejector that has the conventional bump-shaped common bus connection structure discussed above. As shown in FIG. 1, the conventional inkjet printhead drop ejector 10 includes a channel plate 12 and a heater plate 14. The channel and heater plates 12 and 14 combine with a polymer spacer layer (not shown) to form an ink channel 20 extending laterally between the channel plate 12 and the heater plate 14. A polysilicon resistive heater 16 is formed on or over the heater plate 14. The common bus connection structure 18 connects the polysilicon resistive heater 16 to a high-voltage power supply. In particular, in conventional thermal inkjet printers, the high-voltage power supply is usually in the range of between approximately 12 and 50 volts.

When the circuit including the polysilicon resistive heater 16 and the connection structure 18 is closed, current flows through the connection structure 18 and the polysilicon resistive heater 16, causing resistive heating. This resistive heating pumps thermal energy into the ink contained within the ink channel 20. Eventually, a portion of the ink in the ink channel 20 vaporizes, forcing ink past the bump 18 and through a nozzle 22. A top of the nozzle 22 is defined by the channel plate 12, while a bottom of the nozzle 22 is defined by the heater plate 14, and the sides of the nozzle 22 are defined by the polymer spacer layer. In particular, the nozzle 22 is on the other side of the connection structure 18 from the polysilicon resistive heater 16. Thus, the bump-shaped connection structure 18 tends to act as a flow-restriction-like member in the ink channel 20.

The bubble formed in the ink channel 20 causes a portion of the ink 24 to extend out of the nozzle 22. In particular, the force applied by the bubble on the incompressible ink 24 causes a main drop 30 to be ejected from the nozzle 22. However, due to the shape and position of the bump-shaped connection structure 18, one or both of two disadvantageous effects can occur as the main drop 30 is ejected from the ink channel 20.

First, the main drop 32 can be misdirected as it is ejected out of the inkjet nozzle 22. That is, the main drop 30 ideally exits the ink channel 20 in a direction that is perpendicular to the surface of the recording medium 40 at which the ink drop 30 is ejected. However, due to the bump-shaped connection structure 18, the main drop 30 exits the ink channel 20 at an angle to the desired direction, reducing the accuracy of ink spot placement on the recording medium 40 from the desired location.

Secondly, the bump-shaped connection structure 18 can cause disturbances in the flow of the ink as it exits the nozzle 22. When the main drop 30 is ejected from the nozzle 22, one or more small satellite drops 32 are generated which also impact the recording medium 40. This disturbance causes one or more satellite drops 32 to depart from the trajectory of the main drop 30 as the ink is ejected from the nozzle 22. In particular, the satellite drops 32 will be ejected at an angle θ divergent relative to the main drop 30.

Thus, the topography of the ink channel 20 created by the bump-shaped connection structure 18 induces one or more print defects in the images formed by the inkjet printer. As described above, these print defects are related to departures from the ideal flight path of the main drop 30 and differences in the flight paths between the main drop 30 and any satellite drops 32 that may have been ejected with the main drop 30. These defects cause the resulting printed images to be fuzzy, to have elongated spot aspect ratios, to have banding, and/or to have spot width variations. For example, if the inkjet printer forms images by printing swaths in both a forward and a return direction, the motion vector of the printhead will alternately additively or subtractively add to the flight path vectors of the satellite drops, causing the satellite drops to alternatively extend outside of, or fall within, the main drop as it lands on the recording medium 40. Thus, depending on which way the printhead carriage moves relative to the recording medium 40, the size of the spot formed by the combination of the main drop 30 and any satellite drops 32 will change.

Figure 2:
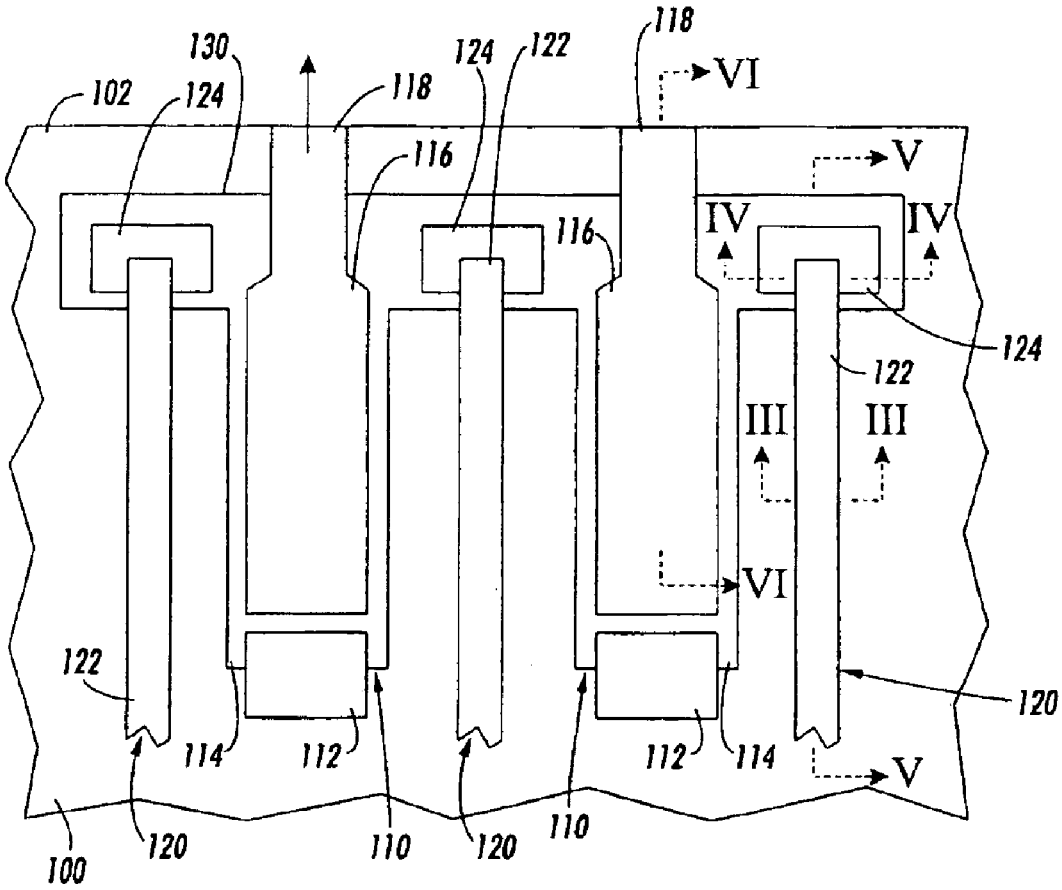
FIG. 2 (PRIOR ART)
FIG. 2 is a plan view of a conventional low-topography fluid ejector.

FIG. 2 is a top plane view of one embodiment of a low-topography inkjet printhead structure 100 ejector, as disclosed in the 657 patent. In particular, FIG. 2 shows a top plane view of the heater plate 102 of the low-topography inkjet printhead structure 100, as disclosed in the 657 patent. As shown in FIG. 2, a plurality of ejector structures 110 is interleaved with a plurality of common bus connection portions 120. Each of the ejector structures 110 includes an address line connection portion 112 that connects that ejector structure 110 to a high-voltage driver transistor that selectively connects and disconnects the ejector structure 110 to ground. The address line connection portion 112 is located at an inlet end of a resistive heater 114. A polymer nozzle structure 116 is formed on or over the resistive heater 114 and ends in a nozzle 118.

Each of the common bus connection structures 120 forms a connection structure 124 that connects a common bus portion 130 to a drive voltage bus that is held at the drive voltage. In general, for most common thermal inkjet printers, the drive voltage is typically between 12 and 50 volts. The common bus portion 130 extends across a front portion of the heater plate 102 and connects to each of the resistive heaters 114. As shown in FIG. 2, the common bus connection portion 120 connects to the drive voltage bus at a location behind the ejector structures 110 relative to the nozzles 118. In particular, the common bus connection portion 120 includes a linear connection portion 122 connected to the common bus portion 130 through the connection structure 124.

Figure 3:
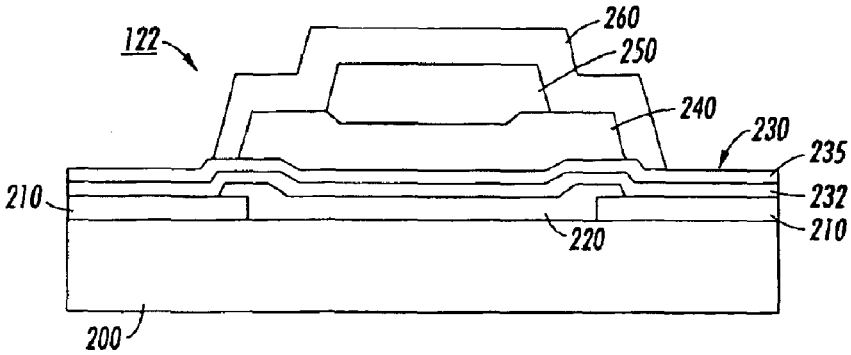
FIG. 3 (PRIOR ART)
FIG. 3 is a transverse cross-sectional view of a conventional linear connection taken along a plane III—III of FIG. 2.

FIG. 3 is a cross-sectional view of the linear connection portion 122 taken across the long axis, i.e., a plane III—III of FIG. 2, of the linear connection portion 122, as disclosed in the 657 patent. As shown in FIG. 3, a field oxide layer 200 forms at least a portion of the heater plate 102. A relatively lightly-doped ($N^+$) polysilicon layer 210 is formed on or over the field oxide layer 200. In the region of the linear portion 122 of the connection portion 120, the relatively lightly-doped polysilicon layer 210 is patterned to form a plurality of the resistive heaters. A first insulative layer 220 is formed and patterned to act as an insulative layer between adjacent resistive heater portions of the patterned and relatively lightly-doped polysilicon layer 210 and a protective layer 230 formed on or over the insulative layer 220 and the relatively lightly-doped polysilicon layer 210.

As shown in FIG. 3, and as disclosed in the 657 patent, the protective layer 230 is a multi-layer protective layer 230. The multi-layer protective layer 230 comprises a pair of layers. In particular, the multi-layer protective layer 230 comprises a lower silicon-nitride 232 layer formed using a chemical vapor deposition process and an upper β-phase tantalum layer 235.

The multi-layer protective layer 230 should overlap the first insulative layer 220 by approximately 2 μm to reduce the likelihood that, outside of the ink channel, the β-phase tantalum layer 235 does not terminate on the polysilicon layers 210, described above, and 270, described below. Otherwise, if the tantalum layer 235 terminates in electrical contact with one of the polysilicon layers 210 or 270, the polysilicon becomes damaged near the edge of the tantalum layer 235 and unacceptably low polysilicon-tantalum breakdown voltages occur.

The protective layer 230 is used both to protect against the cavitation forces generated within the ink channel 20 as vapor bubbles of the ink form and collapse within the ink channel 20 to eject ink drops from the ejector structures 110, and to provide electrical isolation between the polysilicon heater structure 210, which is held at the drive voltage, and the ink 24 in contact with the tantalum layer 235.

A second insulative layer 240 is formed on or over the protective layer 230 and positioned generally vertically over the space formed between the relatively lightly-doped polysilicon layers 210. A conductive metal layer 250 is then formed on or over the second insulative layer 240. An insulative passivation layer 260 is formed on or over the conductive metal layer 250, the second insulative layer 240 and partially over the protective layer 230 to completely encapsulate the second insulation layer 240 and the conductive metal layer 250.

As mentioned above, the protective layer 230 acts as a heater protection layer providing both chemical and mechanical protection to the resistive heater 114 in the ejector structure 110. The passivation layer 260 also acts as a mechanical and chemical protection layer. Because the passivation layer 260 encapsulates the conductive metal layer 250, the passivation layer 260 also provides electrical protection.

Figure 4:
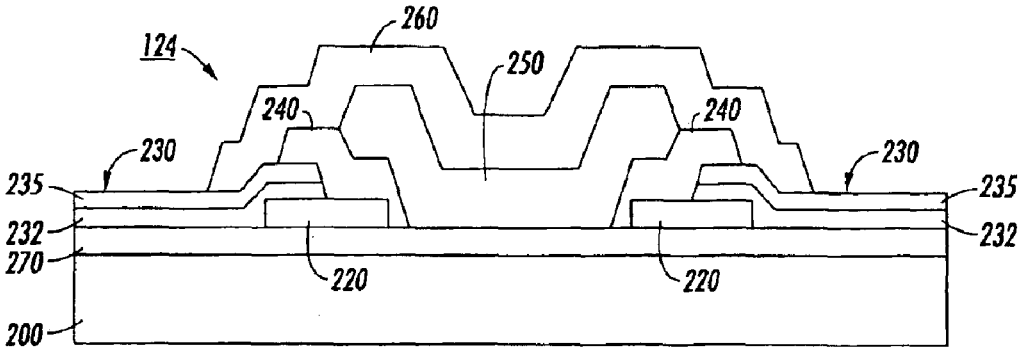
FIG. 4 (PRIOR ART)
FIG. 4 is a cross-sectional view through a conventional connection structure taken along a plane IV—IV of FIG. 2.

FIG. 4 is a cross-sectional view along a plane IV—IV of FIG. 2 and illustrates how the conductive metal layer 250 is electrically connected to a relatively highly-doped ($N^{++}$) polysilicon layer 270 forming the common bus portion structure 130 for the ejector structures 110. As shown in FIG. 4, the relatively highly-doped polysilicon layer 270 is formed on or over the field oxide layer 200 and under the first and second insulation layers 220 and 240 and the protective layer 230. In particular, the conductive metal layer 250 contacts the relatively heavily-doped polysilicon layer 270 either directly or through one or more conductive barrier structures.

Figure 5:
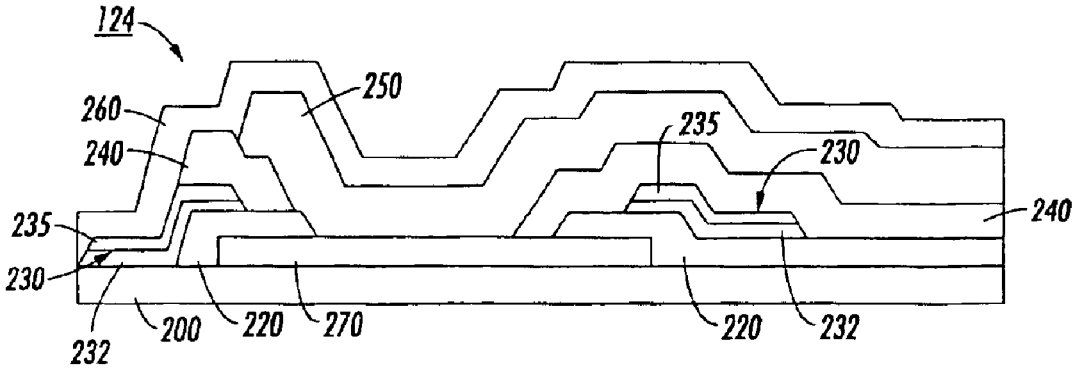
FIG. 5 (PRIOR ART)
FIG. 5 is a longitudinal cross-sectional view of a conventional bus connection structure taken along a plane V—V of FIG. 2.

FIG. 5 is a cross-sectional view from the 657 patent of the common bus connection portion 120, i.e., a plane V—V of FIG. 2, along the long dimension of the common bus connection portion 120, showing both the structure of the linear connection portion 122 and the contact portion 124.

Figure 6:
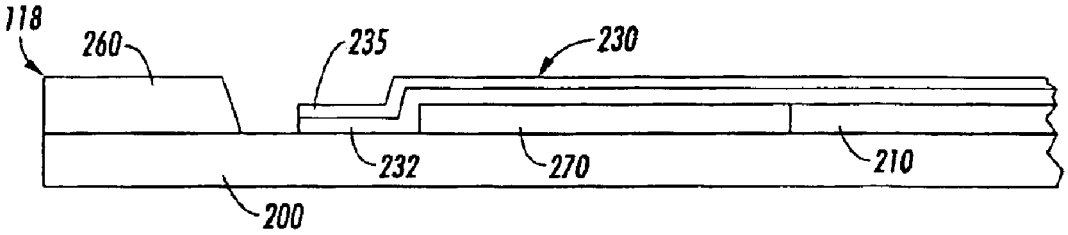
FIG. 6 (PRIOR ART)
FIG. 6 is a longitudinal cross-sectional view of a conventional resistive heater taken along a plane VI—VI of FIG. 2.

FIG. 6 is a cross-sectional view along the long axis, i.e., the line VI—VI of FIG. 2, of the resistive heater 114 and extending through the nozzle 118. As shown in FIG. 6, the common bus portion 130, formed by the relatively heavily-doped polysilicon layer 270, and the resistive heater portion 114, formed by the relatively lightly-doped polysilicon layer 210, are positioned laterally adjacent to each other to form a conductive path from the drive voltage bus to ground through the linear connection portion 122, the connection structure 124, the common bus portion 130, the resistive heater 114 and the address line connection portion 112 to ground. Thus, current flows through the relatively heavily-doped polysilicon layer 270 and into the relatively lightly-doped polysilicon layer 210.

This current flow through the relatively lightly-doped polysilicon layer 210 causes resistive heating in the relatively lightly-doped polysilicon layer 210. In particular, the relatively heavily-doped polysilicon layer 270 has a resistivity that is less than the resistivity of the relatively lightly-doped polysilicon layer 210. This tends to cause most of the resistive heating to occur in the relatively lightly-doped polysilicon layer 210, and relatively little of the resistive heating to occur in the relatively heavily-doped polysilicon layer 270.

The heat created by the resistive heating in the relatively lightly-doped polysilicon layer 210 flows through the thermally conductive protective layer 230 and heats the ink in the ink channel 20 sufficiently to cause the ink to vaporize and eject a drop through the nozzle 118.

As shown in FIG. 6, the passivation layer 260 and the protective layer 230 form a generally flat topography. In particular, the connection structure 118 shown in FIG. 1 is moved out of the ejector structure 110 to a portion of the heater plate 102 that is laterally adjacent to the ejector structure 110, as shown in FIG. 2. Thus, while the complex, multi-layer contact structure 124 that is located at the front of the heater plate 102 is required for each ejector structure 110, this complex, multi-layer contact structure 124 avoids introducing any additional topography into the ejector structure 110 and especially avoids ejecting any additional topography into the ejector structure 110 at locations close to the nozzle 118. In particular, as shown in FIG. 6, the surface of the resistive heater 114 is essentially or substantially flat.

Figure 7:
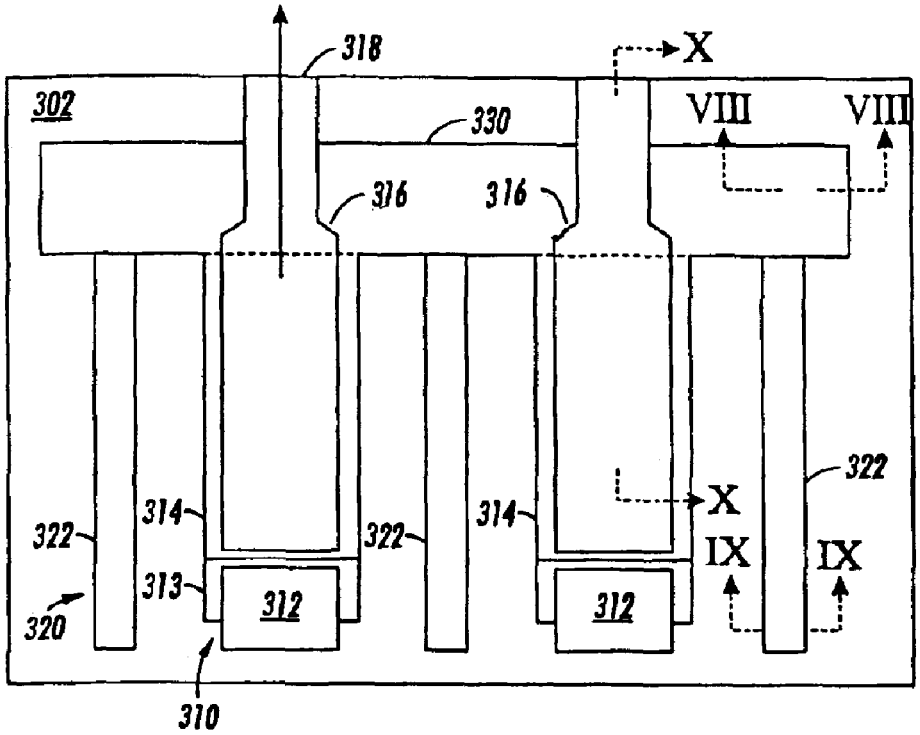
FIG. 7 is a plan view of one exemplary embodiment of a low-topography fluid ejector, according to the invention.

FIG. 7 is a schematic plan view of an exemplary embodiment of the polysilicon feed-through heater, according to this invention. As shown in FIG. 7, a printhead structure 300 includes a heater plate 302 onto which fluid ejector structures 310 and bus connections 320 are formed laterally adjacently to each other. Each ejector structure 310 includes an address line connection 312 communicating with a contact 313 of a resistive heater 314. A polymer nozzle structure 316 ending in a nozzle 318 is formed above and forward of the resistive heater 314. The fluid is ejected from the nozzle 318 in the direction indicated by the upward-pointing arrow.

As shown in FIG. 7, each bus connection 320 includes a connection line 322 communicating over a common bus 330 to a drive voltage source. The common bus 330 extends along and adjacent to the forward edge of the heater plate 302, transversely to the ejector structures 310 and the bus connections 320, and connects to each resistive heater 314. The contact 313 completes the circuit by connecting the resistive heater 314 to the address line 312 in communication with the drive voltage source. These structures may be fabricated using conventional techniques known in the semiconductor and microelectronics industries.

Figure 8:
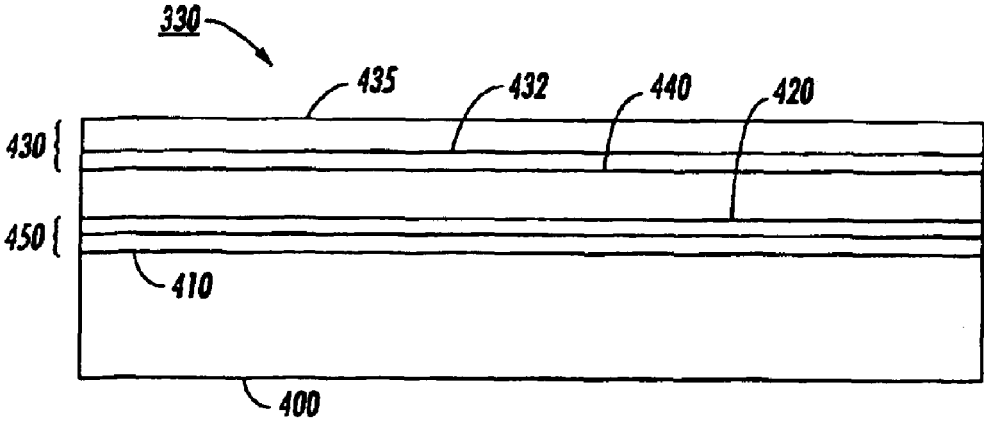
FIG. 8 is a cross-sectional view showing in greater detail a first exemplary embodiment of a connection structure taken along a plane VIII—VIII of FIG. 7, according to the invention.
Figure 9:
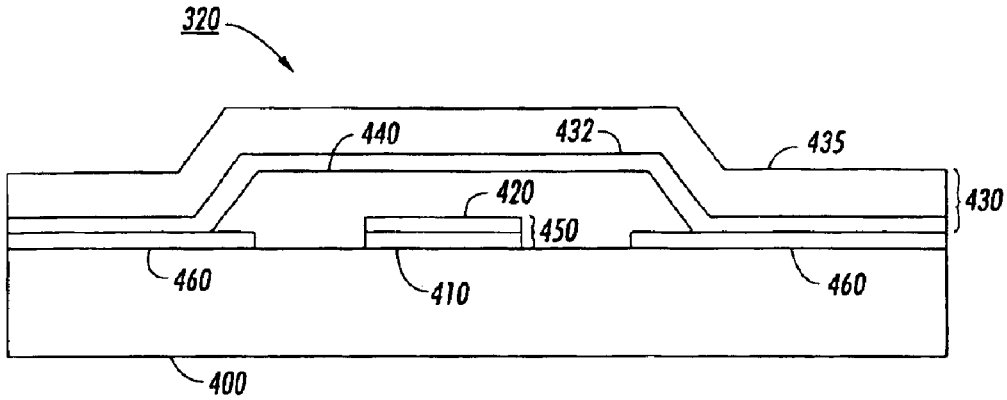
FIG. 9 is a cross-sectional view showing in greater detail a first exemplary embodiment of a linear connection structure taken along a plane IX—IX of FIG. 7, according to the invention.
Figure 10:
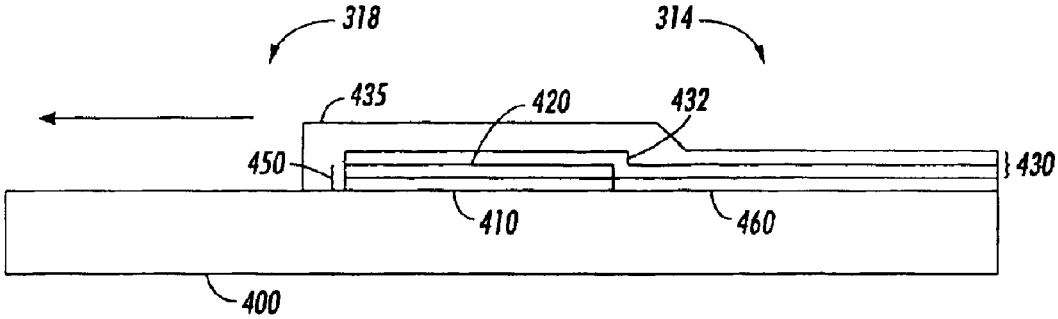
FIG. 10 is a longitudinal cross-sectional view showing in greater detail a first exemplary embodiment along a resistive heater taken along a plane X—X of FIG. 7, according to the invention.

FIGS. 8–10 provide cross-section elevation views through selected structures for a first exemplary embodiment of the polysilicon feed-through heater. FIG. 8 is a cross-section through the first exemplary embodiment of the common bus 330 along a plane VIII—VIII shown in FIG. 7. FIG. 9 is a cross-section across the first exemplary embodiment of the connection line 322 along a plane IX—IX shown in FIG. 7. FIG. 10 is a cross-section through the first exemplary embodiment of the resistive heater 314 along a plane X—X shown in FIG. 7.

FIG. 8 is a cross-sectional view showing in greater detail the first exemplary embodiment of the common bus 330. As shown in FIG. 8, a polysilicon layer is deposited on or over one surface of the field oxide layer 400 for the heater plate 302. A relatively heavily-doped polysilicon layer 410 is produced from the polysilicon layer. A tantalum-silicide layer 420 is formed on or over the relatively heavily-doped polysilicon layer 410 to produce a set of electrically conductive layers 450.

As shown in FIG. 8, an electrically insulating layer 440 is deposited on or over the tantalum-silicide layer 420. A set of protective layers 430 is formed on or over the insulating layer 440. The set of protective layers 430 include a lower silicon-nitride insulating layer 432 and an upper β-phase tantalum coating layer 435.

FIG. 9 is a transverse cross-sectional view showing in greater detail the first exemplary embodiment of the bus connection 320. As shown in FIG. 9, a polysilicon layer is deposited along a pattern over one surface of the field oxide layer 400 that forms the substrate for the heater plate 302. This polysilicon layer is patterned to form the bus connection 320 and the resistive heaters 314.

As shown in FIG. 9, the polysilicon layer 410 is formed by relatively heavily-doping ($N^{++}$) this polysilicon layer to increase its electrical conductivity to as large a value as possible. A polysilicon layer 460 is formed by relatively lightly-doping ($N^{+}$) this polysilicon layer to increase its electrical conductivity to a value appropriate to act as a resistive heating element for ejecting fluid droplets. In various exemplary embodiments, the thicknesses of the relatively heavily-doped and relatively lightly-doped polysilicon layers 410 and 460 are typically between 500 Å and 6000 Å. The relatively heavily-doping of the patterned polysilicon layer is relative to the relatively lightly-doped polysilicon layer 460. The relatively lightly-doping of the patterned polysilicon layer is relative to the relatively highly-doped polysilicon layer 410.

As shown in FIG. 9, the tantalum-silicide ($TaSi_2$) layer 420 is deposited on or over the relatively heavily-doped polysilicon layer 410. In various exemplary embodiments, the layer 420 is formed, for example, by sputtering, followed by high-temperature sintering. In various exemplary embodiments, the thickness of the tantalum-silicide layer 420 is 2000 Å. The tantalum-silicide layer 420 can also be produced by depositing an elemental tantalum (Ta) layer on or over the relatively heavily-doped polysilicon layer 410 and reacting and annealing the structure in a high-temperature, inert environment so that the two layers alloy to form an intermetallic tantalum-silicide layer on or over the relatively heavily-doped polysilicon layer 410.

As shown in FIG. 9, the electrically insulating oxide layer 440 is deposited on or over the tantalum-silicide layer 420. A set of protective layers 430 is deposited on or over the insulating layer 440. The set of protective layers 430 includes the silicon-nitride layer 432, which electrically insulates the layers beneath from any layer above. The tantalum layer 435 is provided on or over the silicon-nitride layer 432 to mechanically and/or chemically isolate the heater plate layers from fluid vapors generated when the fluid to be ejected is vaporized. In various exemplary embodiments, the thickness of the electrically insulating layer 440 is 1000 Å of dry oxide plus 7000 Å of doped glass.

As indicated above, the set of electrically conductive layers 450 includes the relatively heavily-doped polysilicon layer 410 and the tantalum-silicide layer 420. The set of electrically conductive layers 450 can be used, according to this invention, in place of a separately-routed layer of one or more high-conductivity materials, such as, for example, copper (Cu), and/or aluminum (Al).

FIG. 10 is a cross-sectional view showing in greater detail the first exemplary embodiment of the resistive heater 314, with fluid flowing along a direction shown by the left-facing arrow through the nozzle 318. A polysilicon layer is deposited on or over one surface of the field oxide layer 400 for the heater plate 302. The relatively lightly-doped polysilicon layer 460 and the relatively heavily-doped polysilicon layer 410 can be formed adjacently from the deposited polysilicon layer by selective doping. The relatively lightly-doped polysilicon layer 460 and the set of electrically conductive layers 450 are overlaid by the set of protective layers 430, including the silicon-nitride insulating layer 432 and the tantalum coating layer 435.

It should be appreciated that, as outlined below, the resistive heater 314 can be formed by the relatively lightly-doped layer of doped polysilicon 460. However, it should also be appreciated that the resistive heater 314 can also be formed using a thin-film resistor in place of the relatively lightly-doped polysilicon layer 460 within the ink channel. It should further be appreciated that the thin-film resistor can be formed using any appropriate process, such as, for example, sputtering.

In various exemplary embodiments, by forming the common bus and interconnection structures with tantalum-silicide, rather than by simply using relatively highly-doped polysilicon, the interconnect line resistance can be reduced from 2 mΩ-cm to approximately 50 μΩ-cm. With the known highly-doped polysilicon interconnection structures, parasitic resistances prevent efficient drop ejector operation for heater resistivities less than approximately 3000 Ω/□ (ohms/square). In contrast, in various exemplary embodiments according to this invention, the silicide interconnection structures enable efficient operation with heater resistances of 300 Ω/□ or less. Additionally, in various exemplary embodiments of this invention, by replacing the known superstructure of the metal layer 250 and the accompanying insulating layers 220, 232 and 240 and the passivation layer 260, with the set of electrically conductive layers 450 and the set of protective layers 430, the cross-sectional profile through the drop ejector nozzle region may be flattened. This tends to further improve the directional flow consistency of ejected fluid droplets. Finally, replacing the complex cross-sectional structures represented in FIGS. 3–6 eliminates a number of material interfaces and electrical connections which penetrate the protective tantalum layer, resulting in a structure that is much more resistant to attack by corrosive fluids and vapors, and that is far more tolerant to manufacturing variations.

Figure 11:
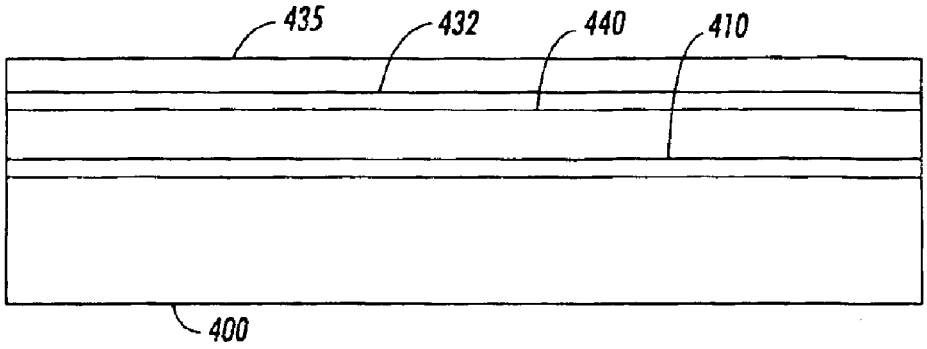
FIG. 11 is a cross-sectional view showing in greater detail a second exemplary embodiment of a connection structure taken along the plane VIII—VIII of FIG. 7, according to the invention.
Figure 12:
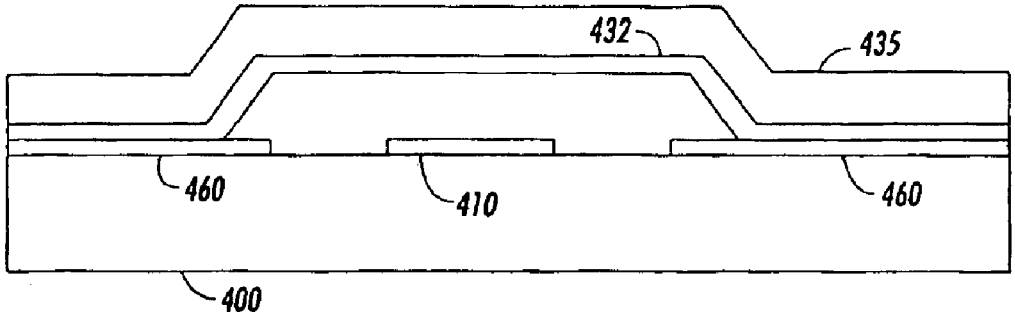
FIG. 12 is a cross-sectional view showing in greater detail a second exemplary embodiment of the linear connection structure taken along the plane IX—IX of FIG. 7, according to the invention.
Figure 13:
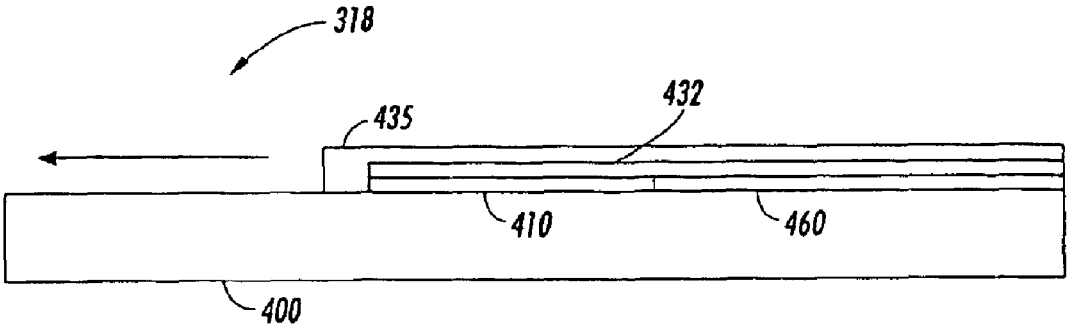
FIG. 13 is a longitudinal cross-sectional view showing in greater detail a second exemplary embodiment along the resistive heater taken along the plane X—X of FIG. 7, according to the invention.

FIGS. 11–13 provide cross-section elevation views through selected structures for a second exemplary embodiment of the polysilicon feed-through heater shown in FIG. 7. FIG. 11 is a cross-section through the second exemplary embodiment of the common bus 330 along the plane VIII—VIII shown in FIG. 7. FIG. 12 is a cross-section across the second exemplary embodiment of the connection line 322 along the plane IX—IX shown in FIG. 7. FIG. 13 is a cross-section through the second exemplary embodiment of the resistive heater 314 along the plane X—X shown in FIG. 7.

As shown in FIG. 11, a polysilicon layer is deposited on or over one surface of the field oxide layer 400 for the heater plate 302. A relatively heavily-doped polysilicon layer 410 is produced from the polysilicon layer to produce an electrically conductive layer. As shown in FIG. 11, an electrically insulating layer 440 is deposited on or over the relatively heavily-doped polysilicon layer 410. A set of protective layers 430 is formed on or over the insulating layer 440. The set of protective layers 430 include a lower silicon-nitride insulating layer 432 and an upper β-phase tantalum coating layer 435.

As shown in FIG. 12, the polysilicon layer 410 is formed by relatively heavily-doping ($N^{++}$) this polysilicon layer to increase its electrical conductivity to as large a value as possible. A polysilicon layer 460 is formed by relatively lightly-doping ($N^{+}$) this polysilicon layer to increase its electrical conductivity to a value appropriate to act as a resistive heating element for ejecting fluid droplets. As indicated above, the relatively heavily-doped polysilicon layer 410 can be used, according to this invention, in place of a separately-routed layer of one or more high-conductivity materials, such as, for example, copper (Cu), and/or aluminum (Al).

FIG. 13 is a cross-sectional view showing in greater detail the second exemplary embodiment of the resistive heater 314, with fluid flowing along a direction shown by the left-facing arrow through the nozzle 318. A polysilicon layer is deposited on or over one surface of the field oxide layer 400 for the heater plate 302. The relatively lightly-doped polysilicon layer 460 and the relatively heavily-doped polysilicon layer 410 can be formed adjacently from the deposited polysilicon layer by selective doping. The relatively lightly-doped polysilicon layer 460 and the relatively heavily-doped polysilicon layer 410 are overlaid by the set of protective layers 430, including the silicon-nitride insulating layer 432 and the tantalum coating layer 435.

Figure 14:
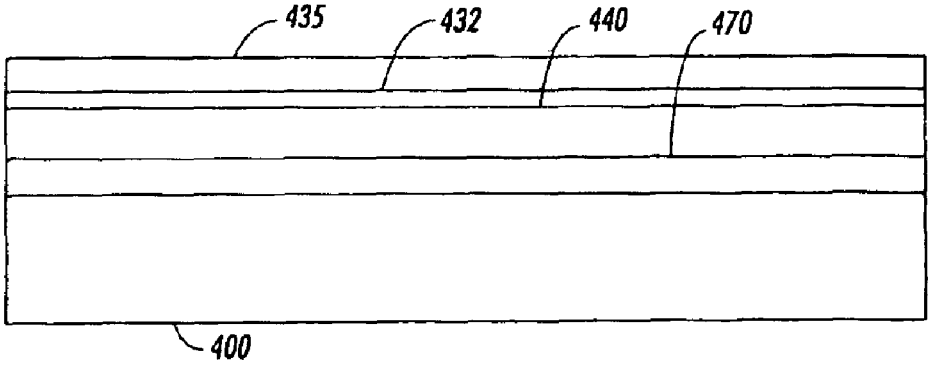
FIG. 14 is a cross-sectional view showing in greater detail a third exemplary embodiment of a connection structure taken along the plane VIII—VIII of FIG. 7, according to the invention.
Figure 15:
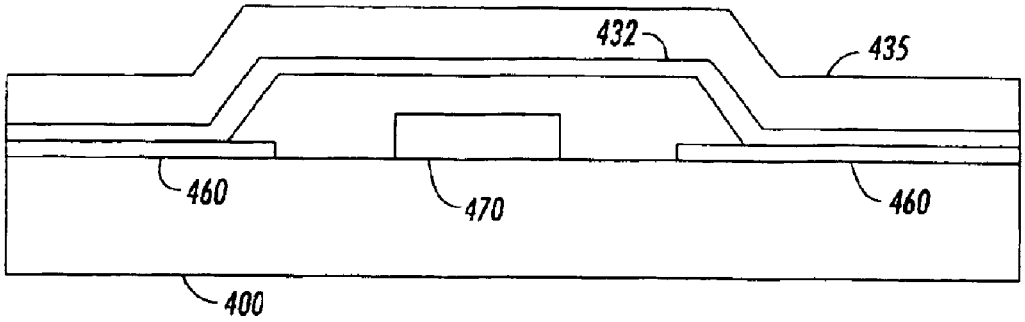
FIG. 15 is a cross-sectional view showing in greater detail a third exemplary embodiment of the linear connection structure taken along the plane IX—IX of FIG. 7, according to the invention.
Figure 16:
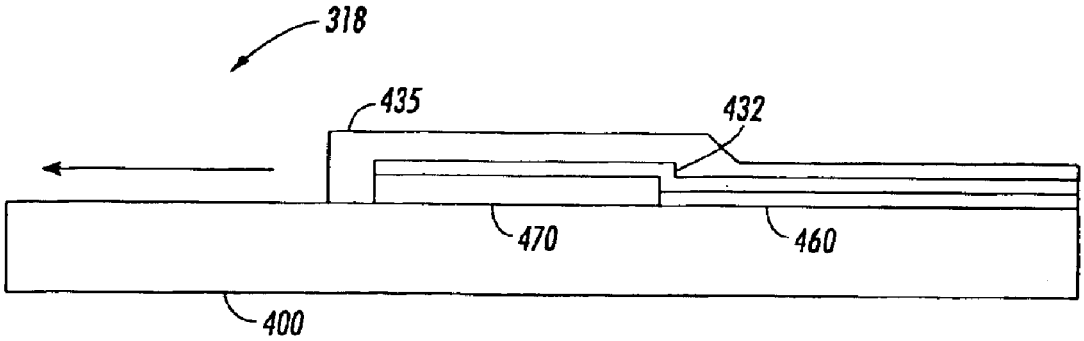
FIG. 16 is a longitudinal cross-sectional view showing in greater detail a third exemplary embodiment along the resistive heater taken along the plane X—X of FIG. 7, according to the invention.

FIGS. 14–16 provide cross-section elevation views through selected structures for a third exemplary embodiment of the polysilicon feed-through heater shown in FIG. 7. FIG. 14 is a cross-section through the third exemplary embodiment of the common bus 330 along the plane VIII—VIII shown in FIG. 7. FIG. 15 is a cross-section across the third exemplary embodiment of the connection line 322 along the plane IX—IX shown in FIG. 7. FIG. 16 is a cross-section through the third exemplary embodiment of the resistive heater 314 along the plane X—X shown in FIG. 7.

As shown in FIG. 14, a polysilicon layer is deposited on or over one surface of the field oxide layer 400 for the heater plate 302. A relatively thick polysilicon layer 470 is produced from the polysilicon layer to produce an electrically conductive layer. The relatively thick polysilicon layer 470 in FIG. 14 is thicker than the relatively heavily-doped polysilicon layer 410 shown in FIGS. 8 and 11 so that the relatively thick polysilicon layer 470 can conduct current with less electrical resistance than otherwise. An electrically insulating layer 440 is deposited on or over the relatively thick polysilicon layer 470. A set of protective layers 430 is formed on or over the insulating layer 440. The set of protective layers 430 include a lower silicon-nitride insulating layer 432 and an upper β-phase tantalum coating layer 435.

As shown in FIG. 15, the relatively thick polysilicon layer 470 is formed by either preferably relatively heavily-doping ($N^{++}$) or else alternately relatively lightly-doping ($N^{+}$) this polysilicon layer to increase its electrical conductivity. A polysilicon layer 460 is formed by relatively lightly-doping ($N^{+}$) this polysilicon layer to increase its electrical conductivity to a value appropriate to act as a resistive heating element for ejecting fluid droplets. The greater cross-sectional area of the relatively thick polysilicon layer 470 will produce a lower current density and thus greater conductivity than the relatively lightly-doped polysilicon layer 460. As indicated above, the relatively thick polysilicon layer 470 can be used, according to this invention, in place of a separately-routed layer of one or more high-conductivity materials, such as, for example, copper (Cu), and/or aluminum (Al).

FIG. 16 is a cross-sectional view showing in greater detail the third exemplary embodiment of the resistive heater 314, with fluid flowing along a direction shown by the left-facing arrow through the nozzle 318. A polysilicon layer is deposited on or over one surface of the field oxide layer 400 for the heater plate 302. The relatively lightly-doped polysilicon layer 460 at the thinner portion and the relatively thick polysilicon layer 470 at the thicker portion can be formed adjacently from the deposited polysilicon layer by selective doping. The relatively lightly-doped polysilicon layer 460 and the relatively thick polysilicon layer 470 are overlaid by the set of protective layers 430, including the silicon-nitride insulating layer 432 and the tantalum coating layer 435.

One exemplary embodiment of a method for forming the polysilicon feed-through heater includes forming the fluid channel 316 with a resistive heater 314, forming the common bus 330 transverse to the fluid channel 316, forming the connection line 322, forming the first set of the one or more layers 450 that electrically connects the common bus 330 with the resistive heater 314 and the connection line 322, and forming the second set of the one or more layers 440 and 430 that covers the common bus 330 and the connection line 322. In various exemplary embodiments, forming the electrically conductive first set of the one or more layers 450 includes forming the heavily-doped polysilicon layer 410 or the relatively thick polysilicon layer 470 on or over the field oxide layer 400, and optionally forming the tantalum-silicide layer 420 on or over the relatively heavily-doped polysilicon layer 410. In various exemplary embodiments, forming the protective second set of the one or more layers 430 includes forming the nitride layer 432 on or over the electrically conductive first set of the one or more layers 450, and forming the tantalum layer 435 on or over the nitride layer 432.

Another exemplary embodiment of a method for forming the fluid channel 316 includes forming the electrically-conductive first set of the one or more layers 450 having the relatively heavily-doped polysilicon layer 410 or 470 on or over the field oxide layer 400, forming the tantalum-silicide layer 420 on or over the heavily doped polysilicon layer 410, forming the relatively lightly-doped polysilicon layer 460 on or over the field oxide layer 400 so that the relatively lightly-doped polysilicon layer 460 is electrically connected to the relatively heavily-doped polysilicon layer 410 or the relatively thick polysilicon layer 470, and forming the protective second set of the one or more layers 430 on or over the tantalum-silicide layer 420 and the relatively lightly-doped polysilicon layer 460.

Yet another exemplary embodiment of a method for forming the common bus includes forming an electrically conductive first set of the one or more layers 450 on or over a first portion of the field oxide layer 400, forming the relatively lightly-doped polysilicon layer 460 on or over a second portion of the field oxide layer 400, forming the insulating layer 440 on or over the electrically conductive first set of the one or more layers 450 and on or over the relatively lightly-doped polysilicon layer 460, and forming a protective second set of the one or more layers 430 on or over the tantalum-silicide layer 420 and the relatively lightly-doped polysilicon layer 460.

While this invention has been described in conjunction with the exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the connection line comprises a field oxide layer;

the first set of one or more layers is formed on or over the field oxide layer and comprises a first doped polysilicon layer formed on or over the field oxide layer; and the first set of one or more layers further comprises a tantalum-silicide layer formed on or over the first doped polysilicon layer.

2. The fluid ejector according to claim 1, wherein the resistive heater heats a fluid in the fluid channel for ejecting the fluid through the nozzle.

3. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the second set of one or more layers is formed on or over the first set of one or more layers and comprises:

a nitride layer formed on or over the first set of one or more layers, and a tantalum layer formed on or over the nitride layer.

4. The fluid ejector according to claim 3, wherein:

the connection line comprises a field oxide layer; and the first set of one or more layers is formed on or over the field oxide layer and comprises a first doped polysilicon layer formed on or over the field oxide layer.

5. The fluid ejector according to claim 4, wherein the resistive heater heats a fluid in the fluid channel for ejecting the fluid through the nozzle.

6. The fluid ejector according to claim 3, wherein the fluid channel is formed on or over a field oxide layer and comprises:

a first set of one or more layers having a first doped polysilicon layer formed on or over a first portion of the field oxide layer;

a second doped polysilicon layer formed on or over a second portion of the field oxide layer electrically connected with the first doped polysilicon layer; and a second set of one or more layers formed on or over the first set of one or more layers and the second doped polysilicon layer.

7. The fluid ejector according to claim 6, wherein the resistive heater heats a fluid in the fluid channel for ejecting the fluid through the nozzle.

8. The fluid ejector according to claim 3, wherein the common bus is formed on or over a field oxide layer and comprises:

a first set of one or more layers formed on or over the field oxide layer, and a second set of one or more layers formed on or over the first set of one or more layers.

9. The fluid ejector according to claim 8, wherein the resistive heater heats a fluid in the fluid channel for ejecting the fluid through the nozzle.

10. The fluid ejector according to claim 3, wherein the common bus is formed on or over a field oxide layer and comprises:

a first set of one or more layers formed on or over a first portion of the field oxide layer;

a second doped polysilicon layer formed on or over a second portion of the field oxide layer and electrically separated from the first set of one or more layers;

an insulating layer formed on or over the first set of one or more layers and a first portion of the second doped polysilicon layer; and a second set of one or more layers formed on or over the insulating layer and a second portion of the second doped polysilicon layer.

11. The fluid ejector according to claim 10, wherein the first set of one or more layers comprises a first doped polysilicon layer formed on or over the field oxide layer.

12. The fluid ejector according to claim 11, wherein the resistive heater heats a fluid in the fluid channel for ejecting the fluid through the nozzle.

13. The fluid ejector according to claim 10, wherein the resistive heater heats a fluid in the fluid channel for ejecting the fluid through the nozzle.

14. The fluid ejector according to claim 3, wherein the resistive heater heats a fluid in the fluid channel for ejecting the fluid through the nozzle.

15. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the fluid channel is formed on or over a field oxide layer and comprises:

a first set of one or more layers having a first doped polysilicon layer formed on or over a first portion of the field oxide layer;

a second doped polysilicon layer formed on or over a second portion of the field oxide layer electrically connected with the first doped polysilicon layer; and a second set of one or more layers formed on or over the first set of one or more layers and the second doped polysilicon layer, the first set of one or more layers further includes a tantalum-silicide layer formed on or over the first doped polysilicon layer, and the second set of one or more layers formed on or over the first set of one or more layers is formed on or over the tantalum-silicide layer.

16. The fluid ejector according to claim 15, wherein the second set of one or more layers comprises:

a nitride layer formed on or over the tantalum-suicide layer and the second doped polysilicon layer; and a tantalum layer formed on or over the nitride layer.

17. The fluid ejector according to claim 16, wherein the resistive heater heats a fluid in the fluid channel for ejecting the fluid through the nozzle.

18. The fluid ejector according to claim 15, wherein the resistive heater heats a fluid in the fluid channel for ejecting the fluid through the nozzle.

19. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending alone the fluid channel; and a connection structure that electrically connects the common bus with the resistive heater and the connection line, the connection structure including a first set of one or more layers that are electrically conductive and a second set of one or more layers that covers the common bus and the connection line, wherein the first doped polysilicon layer is relatively heavily-doped and the second doped polysilicon layer is relatively lightly-doped, and the fluid channel is formed on or over a field oxide layer and comprises:

a first set of one or more layers having a first doped polysilicon layer formed on or over a first portion of the field oxide layer;

a second doped polysilicon layer formed on or over a second portion of the field oxide layer electrically connected with the first doped polysilicon layer; and a second set of one or more layers formed on or over the first set of one or more layers and the second doped polysilicon layer.

20. The fluid ejector according to claim 19, wherein the resistive heater heats a fluid in the fluid channel for ejecting the fluid through the nozzle.

21. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the first set of one or more layers comprises:

a first doped polysilicon layer formed on or over the field oxide layer; and the second set of one or more layers comprises:

a nitride layer formed on or over the first doped polysilicon layer; and a tantalum layer formed on or over the nitride layer.

22. The fluid ejector according to claim 21, wherein the resistive heater heats a fluid in the fluid channel for ejecting the fluid through the nozzle.

23. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the first set of one or more layers comprises:

a first doped polysilicon layer formed on or over the field oxide layer; and a tantalum-silicide layer formed on or over the first doped polysilicon layer; and the second set of one or more layers comprises:

a nitride layer formed on or over the tantalum-silicide layer; and a tantalum layer formed on or over the nitride layer.

24. The fluid ejector according to claim 23, wherein the resistive heater heats a fluid in the fluid channel for ejecting the fluid through the nozzle.

25. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the common bus is formed on or over a field oxide layer and comprises:

a first set of one or more layers formed on or over a first portion of the field oxide layer;

a second doped polysilicon layer formed on or over a second portion of the field oxide layer and electrically senarated from the first set of one or more layers;

an insulating layer formed on or over the first set of one or more layers and a first portion of the second doped polysilicon layer; and a second set of one or more layers formed on or over the insulating layer and a second portion of the second doped polysilicon layer, the first set of one or more layers comprises a first doped polysilicon layer formed on or over the field oxide layer, and the first doped polysilicon layer is relatively heavily-doped and the second doped polysilicon layer is relatively lightly-doped.

26. The fluid ejector according to claim 25, wherein the resistive heater heats a fluid in the fluid channel for ejecting the fluid through the nozzle.

27. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the common bus is formed on or over a field oxide layer and comprises:

a first set of one or more layers formed on or over a first portion of the field oxide layer;

a second doped polysilicon layer formed on or over a second portion of the field oxide layer and electrically separated from the first set of one or more layers;

an insulating layer formed on or over the first set of one or more layers and a first portion of the second doped polysilicon layer; and a second set of one or more layers formed on or over the insulating layer and a second portion of the second doped polysilicon layer, and the first doped polysilicon layer is relatively thicker than the second doped polysilicon layer.

28. The fluid ejector according to claim 27, wherein the resistive heater heats a fluid in the fluid channel for ejecting the fluid through the nozzle.

29. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending alone the fluid channel; and a connection structure that electrically connects the common bus with the resistive heater and the connection line, the connection structure including a first set of one or more layers that are electrically conductive and a second set of one or more layers that covers the common bus and the connection line, wherein the common bus is formed on or over a field oxide layer and comprises:

a first set of one or more layers formed on or over a first portion of the field oxide layer;

a second doped polysilicon layer formed on or over a second portion of the field oxide layer and electrically separated from the first set of one or more layers;

an insulating layer formed on or over the first set of one or more layers and a first portion of the second doped polysilicon layer; and a second set of one or more layers formed on or over the insulating layer and a second Portion of the second doped polysilicon layer, and the first set of one or more layers comprises:

a first doped polysilicon layer formed on or over the field oxide layer; and a tantalum-suicide layer formed on or over the first doped polysilicon layer.

30. The fluid ejector according to claim 29, wherein the first doped polysilicon layer is relatively heavily-doped and the second doped polysilicon layer is relatively lightly-doped.

31. The fluid ejector according to claim 30, wherein the resistive heater heats a fluid in the fluid channel for ejecting the fluid through the nozzle.

32. The fluid ejector according to claim 29, wherein the resistive heater heats a fluid in the fluid channel for ejecting the fluid through the nozzle.

33. A fluid ejector, comprising:

a fluid channel extending in a first direction and having a resistive heater and terminating in a nozzle;

a common bus formed extending in a second direction at an angle to the first direction, the common bus positioned between the resistive heater and the nozzle;

a connection line adjacent to and extending along the fluid channel; and a connection structure that electrically connects the common bus with the resistive heater and the connection line, the connection structure including a first set of one or more layers that are electrically conductive and a second set of one or more layers that covers the common bus and the connection line, wherein the common bus is formed on or over a field oxide layer and comprises:

a first set of one or more layers formed on or over a first portion of the field oxide layer;

a second doped polysilicon layer formed on or over a second portion of the field oxide layer and electrically separated from the first set of one or more layers;

an insulating layer formed on or over the first set of one or more layers and a first portion of the second doped polysilicon layer; and a second set of one or more layers formed on or over the insulating layer and a second portion of the second doped polysilicon layer, and the second set of one or more layers comprises:

a nitride layer formed on or over the first set of one or more layers and the second doped polysilicon layer; and a tantalum layer formed on or over the nitride layer.

34. The fluid ejector according to claim 33, wherein the resistive heater heats a fluid in the fluid channel for ejecting the fluid through the nozzle.

35. A fluid ejector, comprising:

a fluid channel having a resistive heater and terminating in a nozzle;

a common bus formed transverse to the fluid channel and between the resistive heater and the nozzle;

a connection line laterally adjacent to the fluid channel;

a connection layer that electrically connects the common bus with the resistive heater and the connection line, including:

a first doped polysilicon layer formed on or over the field oxide layer, and a tantalum-silicide layer formed on or over the first doped polysilicon layer; and a cover layer that covers the common bus and the connection line, including:

a nitride layer formed on or over the first set of one or more layers, and a tantalum layer formed on or over the nitride layer.

36. The fluid ejector according to claim 35, wherein the resistive heater heats a fluid in the fluid channel for ejecting the fluid through the nozzle.

* * * * *